US008224199B2

(12) United States Patent
Ai

(10) Patent No.: US 8,224,199 B2
(45) Date of Patent: Jul. 17, 2012

(54) IMAGE FORMING APPARATUS FEATURING TONER IMAGE BAND FORMATION AND ADJUSTING IMAGE FORMATION

(75) Inventor: Ryuta Ai, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 542 days.

(21) Appl. No.: 12/361,871

(22) Filed: Jan. 29, 2009

(65) Prior Publication Data

US 2009/0190946 A1 Jul. 30, 2009

(30) Foreign Application Priority Data

Jan. 30, 2008 (JP) ..... 2008-018724

(51) Int. Cl.
*G03G 15/00* (2006.01)

(52) U.S. Cl. ..... 399/49; 399/50; 399/51; 399/53; 399/66; 399/302; 399/308

(58) Field of Classification Search ..... 399/49–51, 399/53, 66, 302, 308
See application file for complete search history.

(56) References Cited

U.S. PATENT DOCUMENTS

| | | | | |
|---|---|---|---|---|
| 6,175,711 | B1 | 1/2001 | Yoshino et al. | 399/297 |
| 7,251,433 | B2 | 7/2007 | Ai et al. | |
| 7,480,470 | B2 | 1/2009 | Ai | |
| 2005/0220478 | A1 * | 10/2005 | Ai et al. | 399/101 |
| 2005/0276620 | A1 | 12/2005 | Omata | |
| 2007/0036575 | A1 * | 2/2007 | Hamano et al. | 399/82 |
| 2007/0242972 | A1 | 10/2007 | Ai | |

FOREIGN PATENT DOCUMENTS

| | | | |
|---|---|---|---|
| JP | 2000-187405 | A | 7/2000 |
| JP | 2002-14589 | A | 1/2002 |
| JP | 2002-229344 | A | 8/2002 |
| JP | 2004-347662 | A | 12/2004 |
| JP | 2005-242009 | A | 9/2005 |
| JP | 2005-352041 | A | 12/2005 |
| JP | 2006-208996 | A | 8/2006 |
| JP | 2006-276065 | A | 10/2006 |
| JP | 2007-79069 | A | 3/2007 |
| JP | 2007-232748 | A | 9/2007 |
| JP | 2007-240673 | A | 9/2007 |
| JP | 2007-304335 | A | 11/2007 |

* cited by examiner

*Primary Examiner* — Ryan Walsh
(74) *Attorney, Agent, or Firm* — Fitzpatrick, Cella, Harper & Scinto

(57) ABSTRACT

In an image forming apparatus, a control portion forms a restoring toner image (restoring toner band) at a position, in which the refreshing toner image overlaps with a control image with respect to a longitudinal direction of a secondary transfer roller, during post-rotation after image formation in an image forming job is completed. The restoring toner band is formed in a length corresponding to 3 full circumferences of the secondary transfer roller for one-sheet image forming job, 2 full circumferences of the secondary transfer roller for 5-sheet image forming job, and one full circumference of the secondary transfer roller for 10-sheet image forming is job. In the case of an image forming job on 50 sheets or more, a lowering in cleaning performance of a secondary transfer member cleaning device for the secondary transfer roller is not caused to occur, so that the restoring toner band is not formed.

9 Claims, 6 Drawing Sheets

IMAGE FORMING APPARATUS FEATURING TONER IMAGE BAND FORMATION AND ADJUSTING IMAGE FORMATION

FIELD OF THE INVENTION AND RELATED ART

The present invention relates to an image forming apparatus including a cleaning device for electrostatically adsorbing and removing a toner image for control transferred onto a transfer member rotated in contact with an image carrying member. Specifically, the present invention relates to control for restoring a cleaning performance of the cleaning device for the transfer member.

An image forming apparatus including a transfer portion at which a toner image is transferred onto a recording material by rotating a transfer member in contact with an image bearing member such as a photosensitive drum, a photosensitive belt or in contact with an image carrying member such as an intermediary transfer belt has been widely used.

Further, an image forming apparatus in which a toner image for control (control image) not to be transferred onto a recording material is formed in an area between toner images for an image to be transferred onto the recording material and is carried on an image carrying member to determine a toner image forming condition and a toner image position for the image has been put into practical use.

Further, an image forming apparatus for obviating backside contamination of a recording material by rotating a cleaning member such as a fur brush in contact with a transfer member to electrostatically adsorption-remove a toner image for control deposited on the transfer member at a transfer portion has also been put into practical use.

Japanese Laid-Open Patent Application (JP-A) 2002-229344 discloses a tandem type image forming apparatus using an intermediary transfer method in which a plurality of toner image forming means is disposed along an intermediary transfer belt. In the image forming apparatus, an electrostatic cleaning device is disposed for the intermediary transfer belt and includes a pair of fur brushes, to which voltages of opposite polarities are applied, which is rotated in contact with the intermediary transfer belt.

JP-A 2000-187405 discloses an image forming apparatus in which an electrostatic cleaning device is provided to a secondary transfer roller for forming a transfer portion in contact with an intermediary transfer belt. The electrostatic cleaning device brings an electroconductive fur brush, to which a voltage of an opposite polarity to a charge polarity of a toner image is applied, into contact with the secondary transfer roller and rotates the electroconductive fur brush in a direction counter to a rotational direction of the secondary transfer roller to electrostatically adsorption-remove a toner image for control which has been transferred onto the secondary transfer roller at the transfer portion. In the image forming apparatus including the electrostatic cleaning device provided to the transfer member, when an image forming job with a small number of sheets of a recording material subjected to image formation is continuously performed to frequently repeat starting and stopping, it has been found that backside contamination of the recording material is liable to occur.

The image forming apparatus is on standby in a sleep state and is actuated when an image forming job for copying or printing is inputted (provided). Then, pre-rotation is performed and thereafter image formation on the recording material is started. During the pre-rotation, without via the recording material, the image carrying member and the transfer member rotate in contact with each other in a state of application of a voltage of 1000 V to 4000 V, so that a toner image forming condition and a toner image transfer condition are set.

For this reason, during the pre-rotation, electric discharge occurs between the image carrying member and the transfer member, so that an electric discharge product is formed and deposited on the transfer member and a cleaning member to lower a cleaning performance, for the transfer member, of the cleaning member. As a result, an amount of toner which is not subjected to an electrostatic absorption force of the cleaning member and is carried on the transfer member is increased to cause an occurrence of backside contamination of the recording material.

As described later, when image formation on a large number of sheets such as several tens of sheets to several hundreds of sheets is performed, an electric discharge product is taken away by the recording material nip-conveyed by the transfer member, thus not being accumulated. For this reason, the cleaning performance of the cleaning member for the transfer member is maintained normally. However, in the case where one sheet copying is intermittently repeated and the pre-rotation is performed on each occasion, the electric discharge product accumulates on the transfer member and the cleaning member in a large amount, so that a normal cleaning performance cannot be maintained and therefore the backside contamination of the recording material is liable to occur.

Further, also during the pre-rotation and post-rotation which are performed in a state in which a transfer electric field is not applied between the transfer member and the image carrying member, toner is transferred from the image carrying member onto the transfer member to cause the backside contamination. The backside contamination is liable to occur by simply rotating the transfer member in contact with the image carrying member without applying a transfer voltage. This is because the toner and an external additive which function as an abrasive is moved from the transfer member to the image carrying member during rotation of the toner image in contact with the image carrying member.

SUMMARY OF THE INVENTION

A principal object of the present invention is to provide an image forming apparatus capable of maintaining a cleaning performance of an electrostatic cleaning device for a transfer member even when image formation on a small number of sheets subjected to the image formation is intermittently performed.

According to an aspect of the present invention, there is provided an image forming apparatus comprising:

an image carrying member;

toner image forming means for forming a toner image on the image carrying member;

a transfer member, contactable to the image carrying member, for forming a transfer portion for electrostatically transferring a toner image onto a recording material;

wherein the toner image forming means is capable of forming an adjusting image for adjusting a toner image forming condition on the image carrying member, in a state in which the transfer member contacts the image carrying member, in a period between adjacent image forming operations during continuous image formation;

a cleaning member, contactable to the transfer member, for removing toner from the transfer member; and an execution portion for executing a function of electrostatically transferring a toner band formed by the toner image forming means, onto at least an area of the transfer member in which the adjusting image is deposited, in a period from completion of image formation in an image forming job for performing a number of image formations on the recording materials less than a predetermined number until start of image formation in a subsequent image forming job.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, several embodiments of the present invention will be described in detail with reference to the drawings. The present invention can be carried out also in other embodiments in which a part or all of constitutions of the respective embodiments are replaced by their alternative constitutions so long as a toner image for supply is formed and transferred onto a transfer member. The toner image for supply may desirably have a length longer than that of a toner image for control with respect to a rotational direction of an image carrying member. However, in the case where an image forming job for continuously forming an image on 50 sheets or more, it is also possible to achieve the substantially same effect by forming the toner image for supply in a length shorter than that of the toner image for control with respect to the rotational direction and then intermittently transferring the toner image for supply onto a transfer member.

In the following embodiments, only a principal portion concerning formation/transfer of a normal toner image will be described but the present invention can be carried out in various uses including printers, various printing machines, copying machines, facsimile machines, multi-function machines, and so on by adding necessary equipment, options, or casing structures.

First Embodiment

Figure 1:
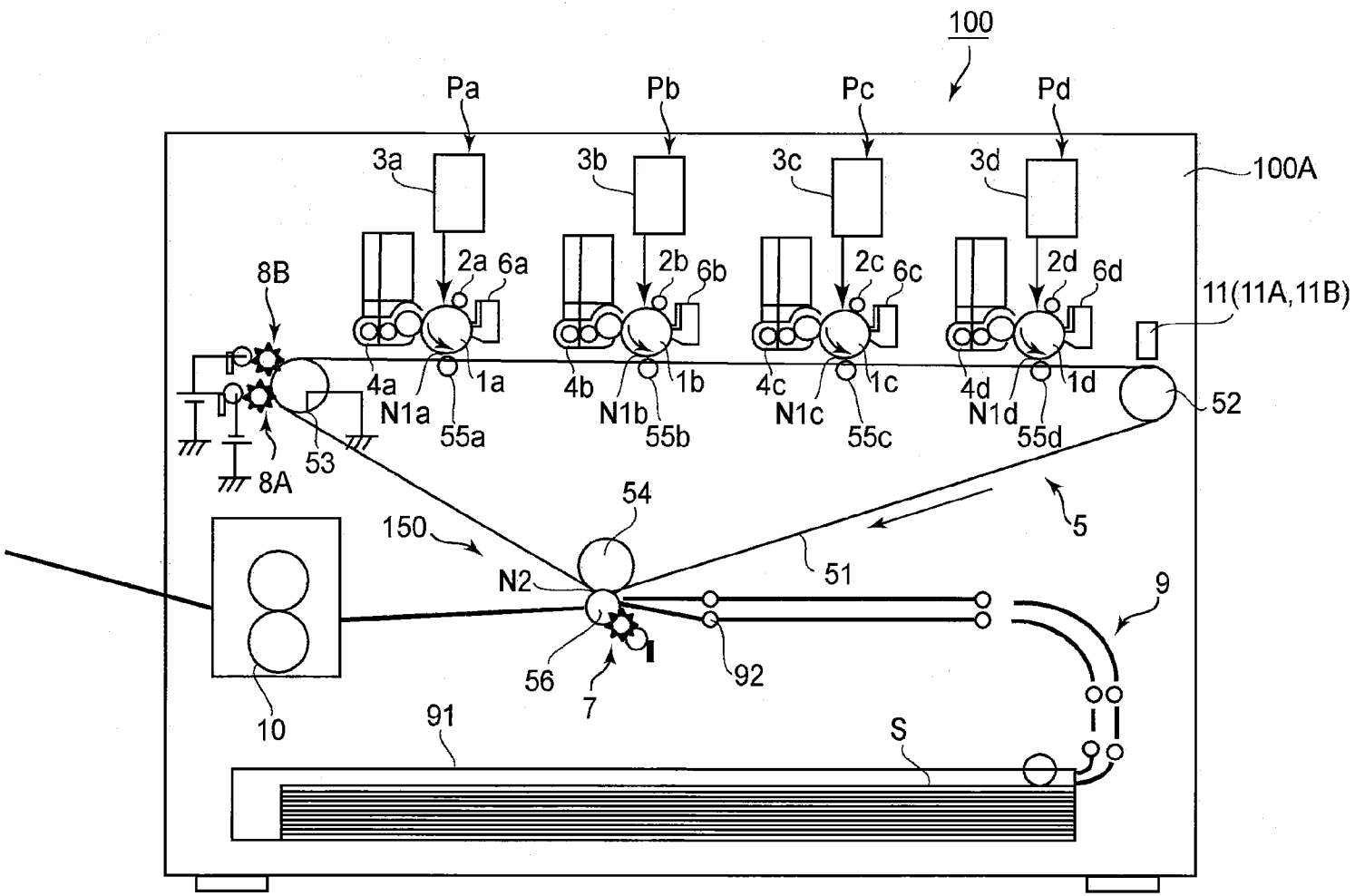
FIG. 1 is a schematic view for illustrating a structure of an image forming apparatus of a First Embodiment.
Figure 2:
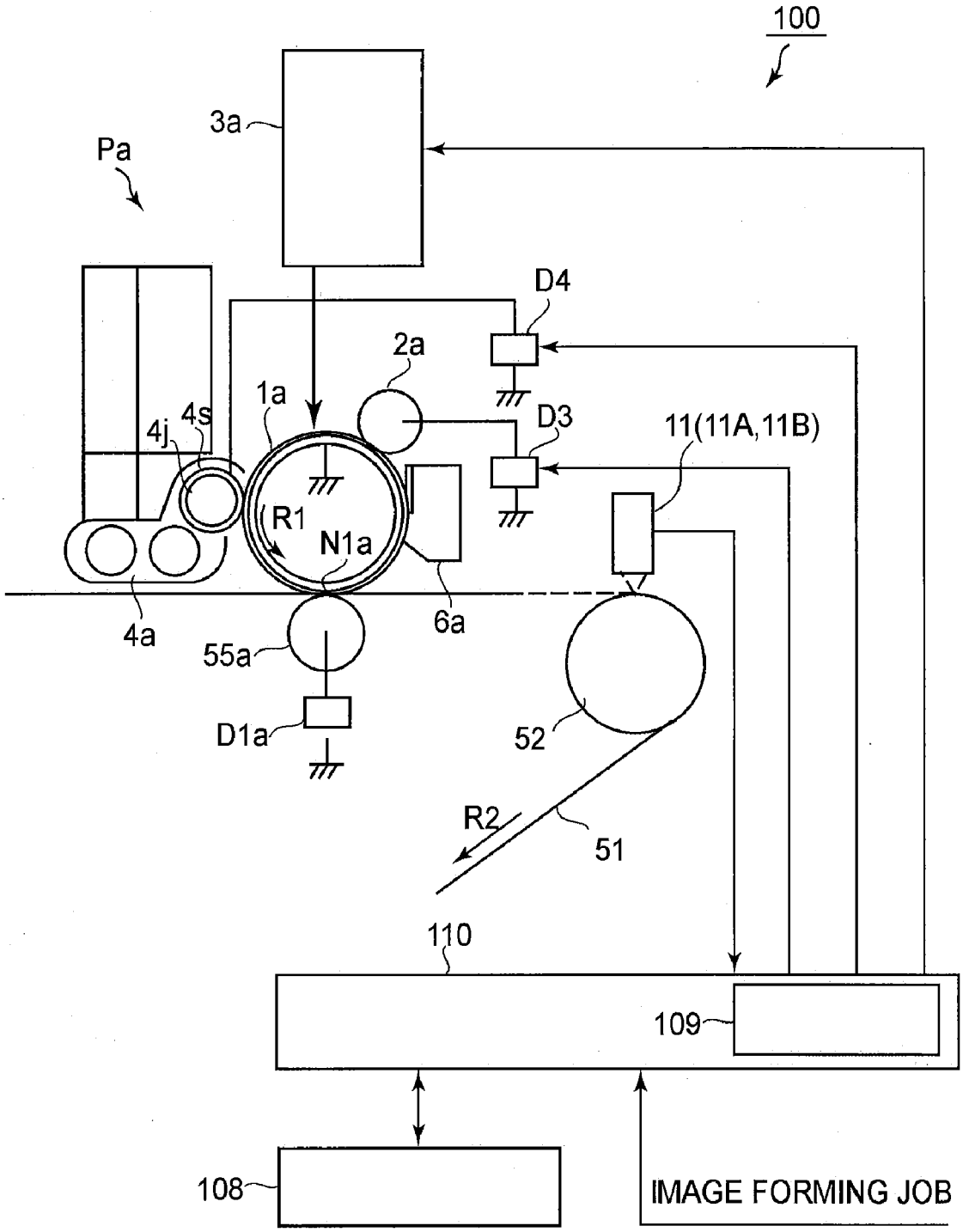
FIG. 2 is a schematic view for illustrating a structure of an image forming station.
Figure 3:
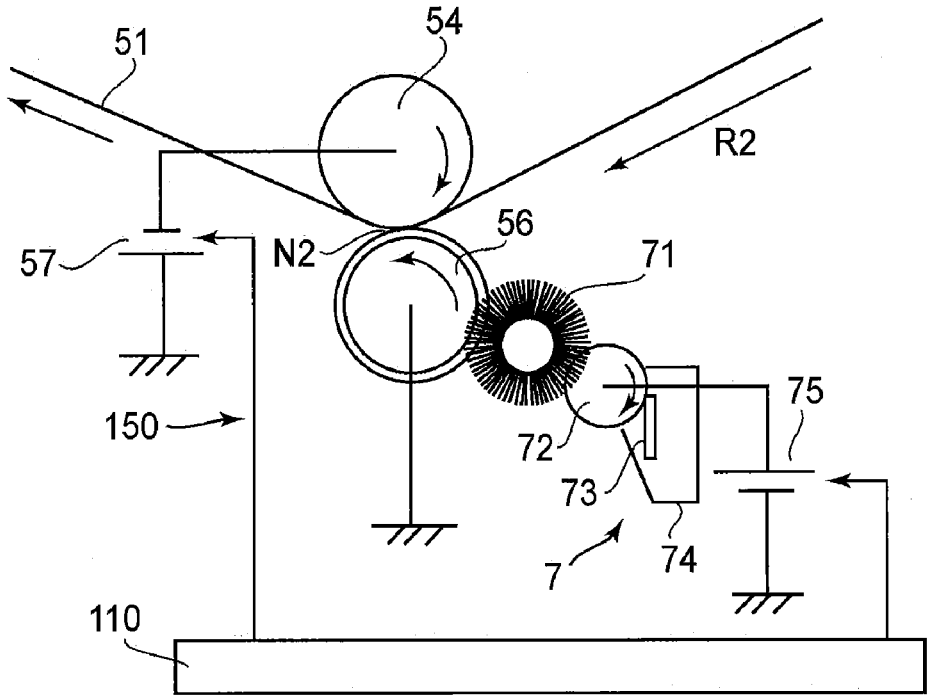
FIG. 3 is a schematic view for illustrating a structure of a secondary transfer portion.

FIG. 1 is a schematic view for illustrating a structure of an image forming apparatus of the First Embodiment, FIG. 2 is a schematic view for illustrating structure of an image forming station, and FIG. 3 is a schematic view for illustrating a structure of a secondary transfer portion.

As shown in FIG. 1, an image forming apparatus 100 of the First Embodiment is a tandem-type full-color printer of an intermediary transfer type in which image forming stations Pa, Pb, Pc and Pd are linearly arranged at a horizontal portion of an intermediary transfer belt 51. To a main assembly 100A of the image forming apparatus 100, external equipment such as a personal computer, an image reading device, or a digital camera is communicatably connected. The image forming apparatus 100 forms a full-color image on a recording material S (plain paper, an OHP sheet, etc.) through electrophotography depending on an image signal sent from the external equipment.

The image forming stations Pa, Pb, Pc and Pd form color toner images of yellow, magenta, cyan and black on photosensitive drums 1*a*, 1*b*, 1*c* and 1*d*, respectively, and then primary-transfer the color toner images onto an intermediary transfer belt 51 at the same image position. An intermediary transfer unit 5 including the intermediary transfer belt 51 is disposed oppositely to the photosensitive drums 1*a*, 1*b*, 1*c* and 1*d*. The intermediary transfer belt 51 is formed of an elastic material in an endless belt shape and is extended around a driving roller 52, a tension roller 53 and a back-up roller 54.

The image forming stations Pa, Pb, Pc and Pd have the substantially same constitution except that the colors of toners in two component developers used in a developing devices 4*a*, 4*b*, 4*c* and 4*d* are different from each other. In the following description, only the image forming station Pa will be described with reference to FIG. 2. Further, with respect to other image forming stations Pb, Pc and Pd, the suffix a of reference numerals (symbols) for representing constituent members (means) is to be read as b, c and d, respectively, for explanation of associated ones of the constituent members.

As shown in FIG. 2, the image forming station Pa includes the photosensitive drum 1*a*. Around the photosensitive drum 1*a*, a charging roller 2*a* as a primary charging means, an exposure device 3*a* as an exposure means, the developing device 4*a* as a developing means, and a cleaning device 6*a* as a cleaning means are disposed in the image forming station Pa.

The photosensitive drum 1*a* as an image bearing member is a drum-like photosensitive member and is rotationally driven in a direction of R1. An intermediary transfer belt 51 is rotated in a direction of an arrow R2 by a driving force transmitted to a driving roller 52. On an inner peripheral surface side of the intermediary transfer belt 51, a primary transfer roller 55*a* is disposed at a position opposite to the photosensitive drum 1*a*. The primary transfer roller 55*a* presses the intermediary transfer belt 51 against the photosensitive drum 1*a* to form a primary transfer portion (primary transfer nip) N1*a*.

During full-color image formation, the charging roller 2*a* is rotated by rotation of the photosensitive drum 1*a* by being supplied with a charging voltage, in the form of a DC voltage biased with an AC voltage, from a power source D3 to electrically charge the surface of the photosensitive drum 1*a* to a uniform dark portion potential.

The exposure device 3*a* scanning-exposes the charged surface of the photosensitive drums to a laser beam, through a polygon mirror or the like, obtained by two-value modulation depending on an image signal of a yellow component color of an original. As a result, a charge potential of a charged portion is lowered to a light portion potential VL, so that an electrostatic image depending on the image signal of the yellow component color is formed on the photosensitive drum 1*a*.

The developing device 4*a* stirs two component developer principally comprising non-magnetic toner and a magnetic carrier to electrically charge the non-magnetic toner to a negative polarity and the magnetic carrier to a positive polarity. The charged two component developer is carried, with a chain thereof, on a surface of a developer-carrying member 4*s* rotating around a fixed magnetic pole 4*j*, thus rubbing against the photosensitive drum 1*a*. To the two component developer, silica particles which is called an external additive having an average particle size of 150 nm is added in an amount of 1% at a weight ratio to the non-magnetic toner in order to improve a charging performance for the toner.

A power source D4 applies to the developer-carrying member 4*s* a developing voltage in the form of a negative-polarity DC voltage biased with an AC voltage, so that the toner carried on the developer-carrying member 48 is moved in an area of the light portion potential VL of the photosensitive drum 1*a* to develop the electrostatic image into a yellow toner image.

The primary transfer roller 55*a* presses the intermediary transfer belt 51 against the photosensitive drum 1*a*, thus forming the primary transfer portion N1*a* at which the intermediary transfer belt 51 contacts the photosensitive drum 1*a*. The yellow toner image reaches the primary transfer portion N1*a* by the rotation of the photosensitive drum 1*a*.

A power source D1*a* applies a DC voltage, to the primary transfer roller 5*a*, of a polarity opposite to the charge polarity of the toner, so that the yellow toner image is primary-transferred from the photosensitive drum 1*a* passing through the primary transfer portion N1*a* onto the intermediary transfer belt 51.

Then, transfer residual toner remaining on the photosensitive drum 1*a* having passed through the primary transfer portion N1*a* is removed by cleaning with the cleaning device 6*a*, so that the photosensitive drum 1*a* is subjected to a subsequent image forming step.

As shown in FIG. 1, the intermediary transfer belt 51 carrying thereon the yellow toner image (normal toner image) is conveyed to a subsequent image forming station Pb. Until this time, at the image forming station Pb, a magenta toner image (normal toner image) has been formed on the photosensitive drum 1*b* in the same manner as that described above. The magenta toner image is primary-transferred onto the yellow toner image on the intermediary transfer belt 51 in the same superposition manner as that described above.

In a similar manner, a cyan toner image (normal toner image) and a black toner image (normal toner image) are primary-transferred onto the toner images on the intermediary transfer belt (image-carrying member) 51 in the superposition manner at primary transfer portions N1*c* and N1*d*, respectively, with progression of image formation at the image forming stations Pc and Pd.

The recording material S is sent from a cassette 91 at a recording material supply portion 9 and is fed to a secondary transfer portion N2 by registration rollers 92 while being timed with the toner images on the intermediary transfer belt 51.

The four color toner images on the intermediary transfer belt 51 are, at the secondary transfer portion N2, secondary-transferred onto the recording material S by a transfer electric field formed between the back-up roller 54 and a secondary transfer roller 56.

As shown in FIG. 3, at a position opposite to the back-up roller through the intermediary transfer belt 51, the secondary transfer roller 56 as a transfer member is disposed. The secondary transfer roller 56 nips the intermediary transfer belt 51 between the secondary transfer roller 56 and the back-up roller 54 to form the secondary transfer portion (secondary transfer nip) N2 at which the secondary transfer roller 56 and the intermediary transfer belt 51 contact each other.

In the First Embodiment, the secondary transfer roller 56 is connected to a ground potential, and a DC voltage of a polarity identical to the toner charge polarity is applied from a transfer power source 57 to the back-up roller 54. However, it is also possible to form a similar transfer electric field in another embodiment in which the back-up roller 54 is connected to a ground potential, and a DC voltage of a polarity opposite to the toner charge polarity is applied to the secondary transfer roller 56.

Then, the recording material S onto which the toner images are transferred is conveyed to a fixing portion 10 (FIG. 1) at which heat and pressure are applied to the toner images, so that the toner images are fixed on the surface of the recording material S as a full-color image.

The transfer residual toner which has passed through the secondary transfer portion N2 and remains on the intermediary transfer belt 51 is removed by cleaning with a first belt cleaning device 8A and a second belt cleaning device 8B, and the intermediary transfer belt 51 is cleaned and then subjected to a subsequent image forming step.

The first and second belt cleaning devices 8A and 8B clean the intermediary transfer belt 51 by electrostatic fur brush cleaning using electroconductive fur brushes to which opposite bias voltages are applied for the devices 8A and 8B, respectively.

The image forming apparatus 100 is capable of executing a black (single color) mode in which a black (single color) toner image is formed by using only a desired image forming station, e.g., the image forming station Pd. In this case, only at the desired image forming station Pd, the image forming step similar to that described above is performed to form only the black (desired color) toner image on the intermediary transfer belt 51. Then, the desired black toner image is transferred onto the recording material S and thereafter is fixed on the recording material S.

<Image Density Control>

Figure 4:
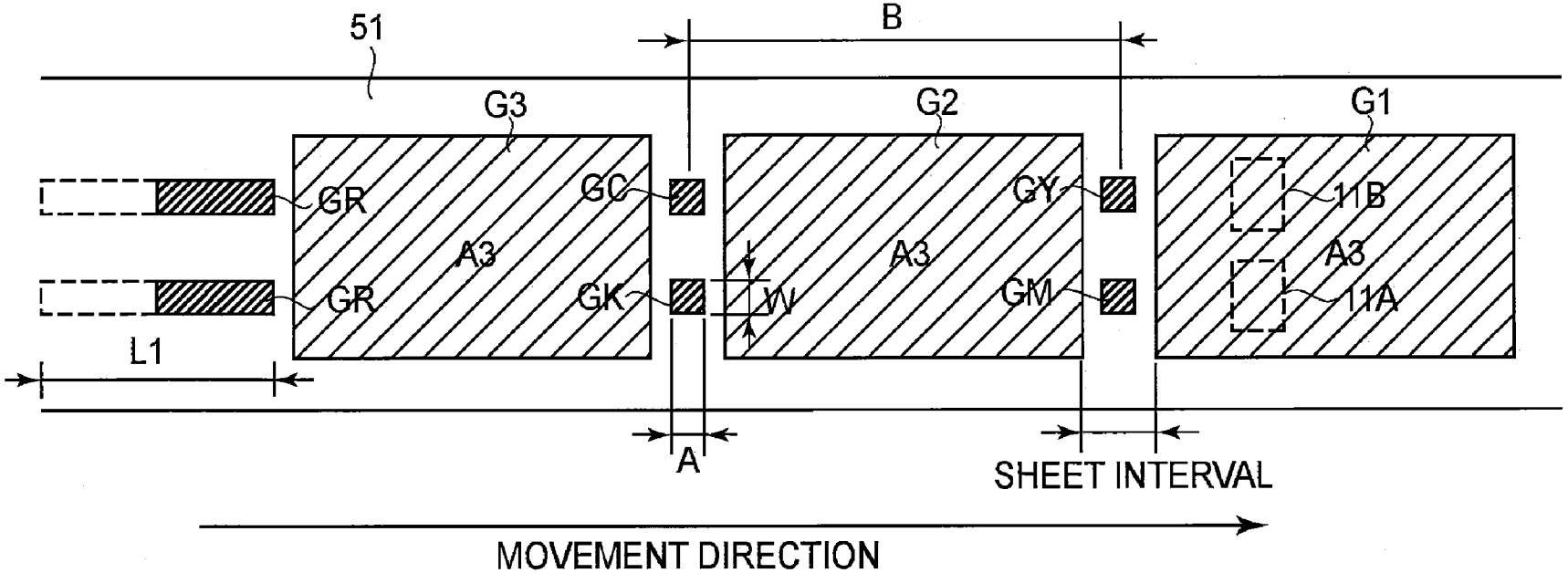
FIG. 4 is a schematic view for illustrating an intermediary transfer belt on which a toner image for controlling an image density is carried.

FIG. 4 is a schematic view for illustrating the intermediary transfer belt 51 on which a toner image for controlling an image density. In FIG. 4, control images (reference toner images for control and patch images) to be formed on the intermediary transfer belt 51 are illustrated by taking the case of feeding a A3-size recording material in a longitudinal feeding manner (in which the recording material is fed so that the longitudinal direction thereof coincides with a conveyance direction thereof) as an example.

In the image forming apparatus 100 for performing full-color image output, in order to achieve high-speed and high-quality image formation, retaining of color stability and density uniformity is a problem to be solved. For this purpose, the toner image for control (hereinafter referred to as a "control image") is formed in a non-image area of the intermediary transfer belt 51, and a reflection density or the like of the control image is detected and fed back to an image forming process condition or the like, so that a stable image density is retained.

The control image is formed correspondingly to the non-image area, e.g., an area between adjacent recording materials during continuous image formation on a plurality of sheets of the recording material (hereinafter referred to as "sheet interval").

The control image is subjected to a step of forming an electrostatic image (reference electrostatic image for control, a developing step and a primary transfer step in the image forming process similar to that for normal image formation at the respective image forming stations Pa to Pd and then is carried on the intermediary transfer belt 51. During the continuous image formation, at each of the image forming stations Pa, Pb, Pc and Pd, a control image is formed between toner images for an image to be transferred onto the recording material and then is primary-transferred onto the intermediary transfer belt 51.

As shown in FIG. 4, control images GY, GM, GC and GK for yellow (Y), magenta (M), cyan (C) and black (K), respectively, are independently carried between images, to be transferred onto the recording materials, on the intermediary transfer belt 51. Reflected light from the control images GY, GM, GC and GK is detected by image density sensors 11A and 11B as a detecting means.

As shown in FIG. 2 with reference to FIG. 4, a control portion 110 as a control means detects image densities of the control images GY, GM, GC and GK for the respective colors on the basis of output of the image density sensors 11A and 11B as a detecting portion for detecting the toner image for control.

The image density sensors 11A and 11B are disposed on the outer peripheral surface side of the intermediary transfer belt 51 and at positions in which the control image is readable. In the First Embodiment, the two image density sensors 11A and 11B are disposed at positions opposite to the driving roller 52 (FIG. 2) with respect to a direction (widthwise direction) perpendicular to a movement direction of the intermediary transfer belt 51.

The image density sensors 11A and 11B are a light-reflection type sensor including a light-emitting portion and a light-receiving portion and emit infrared light to the control images GY, GM, GC and GK carried on the intermediary transfer belt 51 and detect regular (specular) reflection light. Detection signals of the image density sensors 11A and 11B are sent to the control portion 110.

The control portion 110 feeds back a density detection result of each of the control images GY, GM, GC and GK for the respective colors to a toner image forming condition at each of the image forming stations Pa, Pb, Pc and Pd, thus controlling an image density for each of the colors. That is, the control portion effects, as image density control in the exposure device 3*a*, preparation or correction control of γ correction table for determining a rule for converting an inputted image signal depending on an apparatus characteristic, an environment, and the like.

As another image density control, it is possible to employ control of the image forming process condition (developing contrast, laser power, etc.) or toner concentration control (toner supply control) of the two component developer in the developing device 4*a*. Thus, the control portion 110 functions as a changing portion for changing the toner image forming condition on the basis of the output of the image density detection sensors 11A and 11B.

However, the control itself using the control images may be performed in an arbitrary manner and may also be used for control other than the above-described control, e.g., for adjusting exposure start timing at the image forming stations Pa, Pb, Pc and Pd.

As shown in FIG. 4, the control image is formed every time between toner images for images (at a sheet interval) from the viewpoint of image stabilization. From the viewpoint of productivity, a length of the sheet interval with respect to a surface movement direction of the intermediary transfer belt 51 is set as small as possible, so that only a single control image is formed at the sheet interval with respect to the surface movement direction of the intermediary transfer belt 51. The control image is carried at two positions correspondingly to the positions of the image density sensors 11A and 11B with respect to a direction perpendicular to the surface movement direction of the intermediary transfer belt 51. The control image has a width W (a length in the direction perpendicular to the surface movement direction of the intermediary transfer belt 51) of 20 mm and a length A (a length in the surface movement direction of the intermediary transfer belt 51) of 20 mm.

The length A of the control image may preferably be in the range from 20 mm to 70 mm. When the length A is less than 20 mm, sensitivity of the image density sensors 11A and 11B for reading the control image is lowered, thus being liable to cause an error of reading. On the other hand, when the length A of the control image exceeds 70 mm, a length of the sheet interval requires 90 mm or more, so that there is a possibility of a lowering in productivity (the number of output enable sheets per minute) of the image forming apparatus.

The control image is a halftone image with a density gradation level of 128/255 and is formed in an amount of toner per unit area of 0.35 mg/cm$^2$.

<Secondary Transfer Member Cleaning Member>

As shown in FIG. 3 with reference to FIG. 4, a secondary transfer device 150 includes the secondary transfer roller 56 rotated in contact with a toner image-carrying surface of the intermediary transfer belt 51 which is supported by the back-up roller 54 at its inner peripheral surface and is moved around the supporting rollers.

At the sheet interval between recording materials fed to the secondary transfer portion N2, the control images are not transferred onto the secondary transfer roller 56 by moving the secondary transfer roller 56 apart from the intermediary transfer belt 51 or turning off a transfer voltage applied to the back-up roller 54. However, when such control is effected, a mechanism of the secondary transfer device 150 is complicated, thus impairing accuracy and failing to meet an increase in process speed (the number of sheets for image output per minute) in some cases.

Therefore, in this embodiment, the secondary transfer roller 56 is continuously rotated in contact with the intermediary transfer belt 51 even at the sheet interval of the recording material and the transfer electric field is continuously applied between the back-up roller 54 and the secondary transfer roller 56. For this reason, the control images GY, GM, GC and GK disposed at the sheet interval between the toner images for images to be transferred onto the recording material are transferred onto the secondary transfer roller 56 without being transferred onto the recording material.

Therefore, it is necessary to clean the secondary transfer roller 56 so that the control images GY, GM, GC and GK deposit on the back surface of the recording material, having passed through the image area, through the secondary transfer roller 56. The secondary transfer device 150 is provided with a secondary transfer member cleaning device 7 in order to prevent backside contamination of the recording material by quickly removing the control images deposited on the secondary transfer roller 56.

A conventional cleaning device for the secondary transfer roller is generally constituted by a combination of a secondary transfer roller having a surface layer which has been subjected to fluorine coating or the like to stabilize a blade travelling performance, with a blade having a high cleaning performance. Further, from the viewpoint of a conveyance characteristic of the recording material, even in the case of a surface-roughened secondary transfer roller, developing fog toner or the like deposited at the non-image portion in the developing step can be sufficiently removed by cleaning even with the blade.

However, when a high-density toner image such as the control image is completely removed from the surface-roughened secondary transfer roller by cleaning with the blade, it is necessary to increase a contact pressure or contact angle of the blade. The secondary transfer roller and the cleaning blade are an elastic member and have a large frictional force. For this reason, when a linear pressure at a nip portion between the secondary transfer roller and the cleaning blade is increased by increasing the contact pressure or contact angle of the blade, the toner deposits on the cleaning blade and therefore everting of the cleaning blade is liable to occur.

Therefore, in this embodiment, in order to clean the surface-roughed secondary transfer roller, electrostatic fur brush cleaning which is less in surface shape constraint of a member to be cleaned compared with the case of using the blade is employed. In the electrostatic fur brush cleaning, the toner deposited on the member to be cleaned is adsorbed electrostatically by an electroconductive fur brush by application of a DC voltage of a polarity opposite to the toner charge polarity to the electroconductive fur brush. The toner adsorbed by the electroconductive fur brush is electrostatically moved to a metal roller and thereafter is scraped off the metal roller by a cleaning blade, a scraper, or the like to complete the cleaning step.

The secondary transfer roller 56 has a layer structure of two or more layers including an elastic rubber layer and a coating layer (surface layer). The elastic rubber layer is comprised of a foamed layer which has a cell diameter of 0.05-1.0 mm and contains carbon black dispersed therein. The surface layer is formed of a fluorine-containing resin material in a thickness of 0.1-1.0 mm by dispersing therein an ion-conductive polymer.

The secondary transfer roller 56 is a rotatable member having an outer diameter of 24 mm and metal-made central shaft is electrically grounded. The back-up roller 54 is a metal-made rotatable member having an outer diameter of 24 mm.

With respect to a conveyance performance for the recording material, the conveyance performance of the secondary transfer roller 56 is lowered when a surface roughness Rz is 1.5 μm or less. For that reason, the surface roughness Rz of the surface layer of the secondary transfer roller 56 may preferably be controlled to satisfy: Rz>1.5 μm, more preferably be configured to satisfy: Rz>6 μm.

In the case where the toner deposited on the secondary transfer roller 56 is removed by cleaning by the secondary transfer member cleaning device 7 of the electrostatic cleaning type, the cleaning performance is lowered when the surface roughness Rz is 15 μm or more. For that reason, the surface roughness Rz of the secondary transfer roller 56 may preferably be configured to satisfy: Rz>15 μm, more preferably Rz<12 μm.

The secondary transfer roller 56 is constituted by the elastic member having the surface coating layer and may preferably have the surface layer having the surface roughness satisfying: 1.5 μm<Rz<15 μm, more preferably: 6 μm<Rz<12 μm. Thus, by using the secondary transfer roller 56 which has the surface coating layer and is surface-roughened uniformly, it is possible to stabilize the conveyance of the recording material.

The secondary transfer roller 56 may desirably have an electric resistance value of $1.5\times10^5$ ohm/cm to $1.5\times10^6$ ohm/cm. When the resistance value is lower than $1.5\times10^5$ ohm/cm, current is localized on an outside of the recording material, so that the toner is not supplied with a sufficient electric charge and therefore transferability is impaired. Further, when the resistance value exceeds $1.5\times10^6$ ohm/cm, capacity of a high-voltage power source is insufficient or an applied voltage is excessively increased and thus electric discharge leakage is liable to occur. Therefore, in this embodiment, the resistance value of the secondary transfer roller 56 is $5\times10^5$ ohm/cm.

The transfer power source 56 applies a transfer voltage to the back-up roller 54 during pre-rotation before start of formation of the toner image to be transferred onto the recording material, during transfer of the toner image onto the recording material, and during passing of the toner image for control through the transfer portion. The transfer voltage is a DC voltage of −3 kV which has a polarity identical to the toner charge polarity (negative polarity).

The secondary transfer roller 56 may preferably be rotated at a peripheral speed (surface movement speed) in the range from 200 mm/sec to 500 mm/sec. In this embodiment, the secondary transfer roller 56 rotates at a peripheral speed of 300 mm/sec substantially equal to the rotational speed of the intermediary transfer belt 51, and the back-up roller 54 rotates at the substantially same peripheral speed as that of the secondary transfer roller 56.

A fur brush 71 as the cleaning member is disposed in contact with the secondary transfer roller 56 and negatively charges the secondary transfer roller 56 to remove the toner deposited on the secondary transfer roller 56 from the secondary transfer roller 56 by electrostatic adsorption.

A metal roller 72 is disposed in contact with the fur brush 71 as a voltage application member and applies a cleaning voltage of a positive polarity to the fur brush 71 and removes the toner deposited on the fur brush 71 by electrostatic adsorption. The metal roller 72 may preferably be formed of a material excellent in electroconductivity such as aluminum or SUS.

The metal roller 72 rotates, at a contact portion with the fur brush 71, at a peripheral speed equal to that of the secondary transfer roller 56 and in a rotational direction identical to that of the secondary transfer roller 56.

A cleaning blade 72 is disposed in contact with the metal roller 72 and scrapes off the toner carried on the metal roller 72 and collects the toner in a residual toner container.

A cleaning power source 75 is connected to a rotation shaft of the metal roller 72, as a cleaning voltage output means. A cleaning voltage outputted from the cleaning power source 75 is applied to the fur brush 71 through the metal roller 72. In this embodiment, an output voltage from the cleaning power source 75 is +500 V.

By applying the cleaning voltage to the metal roller 72, current passes between the secondary transfer roller 56 and the metal roller 72 through the fur brush 71, so that a potential difference between the secondary transfer roller 56 and the metal roller 72 is generated due to the resistance value of the fur brush 71.

The negatively charged toner electrostatically adsorbed from the secondary transfer roller 56 to the fur brush 71 is moved to the relatively positive metal roller 72 by the above potential difference. The toner carried on the metal roller 72 is rubbed and removed by the cleaning blade 72 contacting the metal roller 72. As a result, the toner collected from the secondary transfer roller 56 is stagnated on the fur brush 71, so that the secondary transfer member cleaning device 7 is prevented from lowering in cleaning performance.

The fur brush 71 may preferably have an outer diameter of 10-30 mm in a state in which the fur brush 71 does not enter the secondary transfer roller 56 as the member to be cleaned, from the viewpoint of a disposed space. In this embodiment, the outer diameter of the fur brush 71 is 18 mm, so that a radius of the fur brush 71 is 9 mm in a state in which the fur brush 71 does not enter the secondary transfer roller 56.

The fur brush 71 has a fur (bristle) length of 4 mm, a depth of impression of a fur tip on the secondary transfer roller 56 of 1.0 mm, and a depth of impression of the fur tip on the metal roller 72 of 1.5 mm.

The fur brush 71 has an implantation density of 120,000/inch$^2$ and an electric resistance value of $3\times10^5$ ohm/cm.

Incidentally, the cleaning device of the electrostatic cleaning type removes the toner on the member to be cleaned with the cleaning member by adsorption through an electrostatic force, so that cleaning power is lower than that of the case of a blade type. Therefore, the cleaning performance largely varies depending on even a slight change in depositing force of the toner on the member to be cleaned. This phenomenon is most conspicuous with respect to an electric discharge product produced by electric discharge occurring between the intermediary transfer belt 51 and the secondary transfer roller 56 due to the transfer voltage.

To the secondary transfer roller 56, in order to transfer the toner image for the image onto the recording material, a DC voltage of approximately 1000-4000 V is applied. In such a high-voltage application state, the electric discharge phenomenon occurs between the secondary transfer roller 56 and the intermediary transfer belt 51 or the recording material. The electric discharge phenomenon causes dissociation/bonding reaction with nitrogen and the like in the ambient air to produce the electric discharge product represented by NOx. When such an electric discharge product deposits on the surface of the secondary transfer roller 56, surface free energy is increased to increase a depositing force of the toner particles on the surface of the secondary transfer roller 56. The surface of the secondary transfer roller 56 at which the electrical discharge phenomenon occurs frequently and the surface free energy is high is considerably lowered in cleaning performance of the fur brush 71 when compared with a surface at which the surface free energy is low.

According to study of the present inventor, in the case where the deposit force of the toner on the secondary transfer roller 56 is increased by the electric discharge product, it has been found that the toner depositing force can be decreased by lowering the surface free energy by the following processes.

A first process is removal of the toner, after being applied onto the surface of the secondary transfer roller 56, by the secondary transfer member cleaning device 7. In the toner contained in the two component developer, fine particles, which are called an external additive, having a particle size of several tens of nm to several hundreds of un are contained. The external additive covers the entire toner particles to ensure flowability of the two component developer. Most of the external additive deposits on the toner particles as it is but a part of the external additive is separated from the toner particles to constitute a free external additive.

When the toner is applied onto the secondary transfer roller 56, the free external additive deposits on the fur brush 71 and rubs against the surface of the secondary transfer roller 56, and the external additive deposited on the secondary transfer roller 56 rubs against the surface of the fur brush 71. The external additive constituted by silica or the like functions as an abrasive substance and removes the electric discharge product deposited on the surface to be rubbed. The external additive has a particle size smaller than that of the toner and has a surface area larger than that of the toner, so that an effect of removing the electric discharge product from the surface to be rubbed is large.

A second process is passing of paper through the secondary transfer portion N2. The paper is constituted by a fine fiber principally comprising cellulose and when the paper is nip-conveyed between the intermediary transfer belt 51 and the secondary transfer roller 56, the fiber is partly broken to generate paper power in the form of an aggregate of several μm. Particles and the paper powder contained in the paper also have the abrasive effect similarly as in the above-described external additive, thus achieving an effect of mutually removing the electric discharge product between the secondary transfer member cleaning device 7 and the secondary transfer roller 56.

<Control Means>

As shown in FIG. 3 with reference to FIG. 2, the control portion 110 forms the toner image for control for being transferred onto the transfer member 56 in such an image forming job that the number of sheets of the recording material conveyed at a position corresponding to a position of the control image GY at the secondary transfer portion N2 is smaller than a predetermined number of sheets.

The control portion 110 forms the toner image for control to be transferred and transfers the formed toner image for control onto the transfer member 56 in a period from completion of image formation in a current image forming job until start of image formation in a subsequent image forming job. That is, the control portion 110 functions as an execution portion for executing supply of the toner by the electric field generated at the transfer portion by the transfer power source in the period from completion of image formation in the current image forming job until start of image formation in the subsequent image forming job in the case where an image forming job for performing the number of image formations on the recording materials less than a predetermined value is executed.

Specifically, during post-rotation performed after completion of image formation contained in an image forming job, the image forming station Pa is controlled to form the yellow toner image which is then transferred onto the secondary transfer roller 56 through the intermediary transfer belt 51.

Hereinafter, the toner image transferred onto the transfer member is referred to as a "restoring toner band". The restoring toner band is formed with the yellow toner image. This is because backside contamination of the recording material is not conspicuous compared with other toners such as the black toner even when image formation is started in a state in which the toner image remains on the secondary transfer roller 56. Therefore, in the case where an image forming station using a white toner or a developing device using a transparent toner is provided, the restoring toner band should be formed with the white toner rather than the yellow toner and should also be formed with the transparent toner rather than the white toner.

The restoring toner band may desirably be transferred onto a longitudinal position on the secondary transfer roller 56 onto which the control image is basically transferred. This is because the electric discharge product is mainly removed from an area in which the backside contamination of the recording material is caused by the deposition of the control image.

Therefore, in this embodiment, the restoring toner band is formed at thrust positions (two positions with respect to a direction perpendicular to the surface movement direction of the intermediary transfer belt 51) identical to those of the control images GY, GM, GC and GK shown in FIG. 4.

The restoring toner band may desirably have a length which is an integral multiple of an outer circumferential length of the secondary transfer roller 56 because the restoring toner band is required to be uniformly supplied onto the secondary transfer roller. In this embodiment, the outer diameter of the secondary transfer roller 56 is 24 mm, so that the length of the restoring toner band is not less than 75.4 mm which is longer than those of the control images GY, GM, GC and GK shown in FIG. 4.

With respect to the electric discharge phenomenon described above, the image forming apparatus is changed in operation time depending on a print number in a job. The operation time is increased with an increasing print number in a job, while a direct electric discharge time is increased with a decreasing print number of a job. The reasons for these phenomenon are as follows.

During the printing, it takes a waiting time to some extent generally called a pre-rotation time from pushing of a copy start button on an operation panel 108 (FIG. 2) by a user until the image forming apparatus 100 actually starts image formation. During the pre-rotation time, e.g., the potential of the photosensitive drum 1*a* is stabilized, the surface of the intermediary transfer belt 51 is cleaned once, or control for setting a voltage to be applied to the secondary transfer roller 56 is made. During the pre-rotation time, the transfer voltage is applied between the secondary transfer roller 56 and the intermediary transfer belt 51 in a state in which there is no transfer or recording material, so that the surfaces of the secondary transfer roller 56 and the intermediary transfer belt 51 are subjected to an electric discharge state and thus the electric discharge product is continuously deposited on the surfaces.

It takes a waiting time to some extent generally called a post-rotation time from completion of copying on the number of sheets designated by the use until the image forming apparatus 100 is actually stopped. During the post-rotation time, similarly as in the pre-rotation, e.g., the potential of the photosensitive drum 1*a* is stabilized, the surface of the intermediary transfer belt 51 is cleaned once, or control for setting a voltage to be applied to the secondary transfer roller 56 is made. Also during the post-rotation time, the transfer voltage is applied between the secondary transfer roller 56 and the intermediary transfer belt 51 in a state in which there is no transfer or recording material, so that the surfaces of the secondary transfer roller 56 and the intermediary transfer belt 51 are subjected to an electric discharge state and thus the electric discharge product is continuously deposited on the surfaces.

For this reason, an accumulation state of the electric discharge product largely varies depending on a balance between a recording material contact time and the sum of the pre-rotation time and the post-rotation time, i.e., the number copying sheets designated by the user.

When a job with a smaller number of copies to be made is performed intermittently, removal of the electric discharge product by passing of the recording material through the secondary transfer portion N2 cannot catch up with the accumulation of the electric discharge product deposited on the secondary transfer roller 56 due to the electric discharge during the pre-rotation and the post-rotation. In an extreme case, in such a state in which the user makes a copy with one-sheet setting and, immediately after the image forming apparatus 100 is stepped, makes again a copy with one-sheet setting, the secondary transfer roller 56 is covered in a large thickness with the electric discharge product in a relatively short time.

The increase in surface free energy of the secondary transfer roller 56 by the electric discharge product increases the depositing force of the toner particles to cause an occurrence of defective cleaning of the control images by the secondary transfer member cleaning device 7, thus leading to the backside contamination of the recording material.

In the case of a job with a larger number of copies to be made, the time of contact of the recording material with the secondary transfer roller 56 is longer than the accumulation time of the electric discharge product deposited on the secondary transfer roller 56 due to the electric discharge in the pre-rotation time and the photo-rotation time. By that much, an amount of the paper powder generated at the secondary transfer portion N2 is increased, so that the abrasive effect of the paper powder acting between the secondary transfer roller 56 and the intermediary transfer belt 51 is increased. As a result, the electric discharge product is not accumulated on the secondary transfer roller 56.

Incidentally, during the pre-rotation and the post-rotation, the secondary transfer roller 56 may also be configured not to be electrically charged.

This is because, even in the case where the secondary transfer roller 56 is not electrically charged, an amount of the toner or the external additive deposited on the secondary transfer roller 56 is decreased by only the rotation of the secondary transfer roller 56 in contact with the intermediary transfer belt 51, so that the backside contamination of the recording material is liable to occur in subsequent image formation. Further, even with respect to such a backside contamination, a deficient amount of the toner or the external additive is supplied to the secondary transfer roller 56 by using the restoring toner band, so that the backside contamination can be effectively suppressed.

In the image forming apparatus 100, the pre-rotation time from the pushing of the start button by the user until the image is actually formed was 20 seconds. The pre-rotation time (20 seconds) includes 5 seconds for a time for stabilizing an electric potential generated by electrically charging the photosensitive drum 1*a*, 5 seconds for a time for removing the toner remaining on the intermediary transfer belt 51 in a slight amount, and 10 seconds for a time for setting a transfer voltage providing an optimum transfer efficiency.

Further, the post-rotation time from the completion of the image formation in an image forming job until the image forming apparatus 100 is actually stopped was 10 seconds. The post-rotation time (10 seconds) includes 5 seconds for a time for removing is the toner remaining on the intermediary transfer belt 51 in a slight amount and 5 seconds for a time for providing optimum charge setting with respect to the photosensitive drum 1*a*. In the pre-rotation time and the post-rotation time, the secondary transfer roller 56 and the intermediary transfer belt 51 are continuously driven rotationally in contact with each other and the transfer voltage is continuously applied.

Experiment 1

When cleaning of the secondary transfer roller 56 by the secondary transfer member cleaning device 7 was studied, it was found that the following problem applied.

In the case where an image formation test on a large number of sheets was conducted on the assumption that a user sets various numbers of copies to be made and makes the copies, it was possible to maintain a good cleaning performance when the number of copies was not less than a certain desired number of copies. However, in the case where the number of copies was less than the certain desired number of copies, defective cleaning of the secondary transfer roller 56 occurred and backside contamination of the recording material was observed.

In order to confirm that the cleaning performance for control images are considerably changed depending on a balance between the number of copies set by the user and times of pre-rotation and post-rotation, Experiment 1 described below was conducted.

Herein, an image forming operation for the number of copies set by the user is referred to as a "job", and the number of copies set by the user is referred to as a "job volume". Between adjacent jobs, intermittence is provided. For example, when the user pushes a copy button with setting of one sheet for the number of copies, this job is referred to as "1-job". When the user pushes the copy button with setting of 1000 sheets for the number of copies, this job is referred to as "1000-job".

In Experiment 1, the job volume was set at six levels of 1 sheet, 5 sheets, 10 sheets, 20 sheets, 50 sheets, and 1000 sheets and the cleaning performance for control images by the secondary transfer member cleaning device was evaluated.

TABLE 1

| Job volume (sheets) | Back side contamination |
|---|---|
| 1 | Occurred |
| 5 | Occurred |
| 10 | Occurred |
| 20 | Occurred |
| 50 | Not occurred |
| 1000 | Not occurred |

Experiment 1 was conducted in an environment of room temperature (22° C.) and a relative humidity of 50% and an evaluation image had 10% duty of an image ratio to the size of paper. As the recording material, a plain paper for PPC (80 g/m$^2$; available from Canon Kabushiki Kaisha) was used. The recording material had an A3 size. The number of sheets for evaluation of image formation was 5000 sheets in total for each of the job volumes.

As shown in Table 1, with respect to the cleaning performance for the control images in Experiment 1, backside contamination of paper generated due to defective cleaning of the control images was observed in 1-job, 5-job, 10-job and 20-job. However, in 50-job and 1000-job, the backside contamination of paper with the control images was not observed.

As described above, the cleaning performance of the secondary transfer member cleaning device for the secondary transfer roller 56 largely varies depending on the job volume. Depending on a balance between accumulation of electric discharge in the pre-rotation time and the post-rotation time and the number of copies designated by the user, surface free energy of the secondary transfer roller 56 is changed largely.

In order to make this phenomenon understandable, an electric discharge accumulation time in the pre-rotation time and in the post-rotation time and an image formation time in the case of a designated number of copies were obtained with respect to each of the job volumes (1-job, 5-job, 10-job, 20-job, 50-job and 1000-job). When a time in which the secondary transfer roller 56 and the intermediary transfer belt 51 cause electric discharge in a non-sheet-passing state is taken as T1 and a time in which the secondary transfer roller 56 and the intermediary transfer belt 51 cause electric discharge in a sheet-passing state is taken as T2, a time ratio Tα=T2/T1 is as shown in Table 2.

TABLE 2

| Job volume (sheets) | Backside contamination | Tα | *1 C.A. (degrees) |
|---|---|---|---|
| 1 | Occurred | 0.049 | 53 |
| 5 | Occurred | 0.19 | 58 |
| 10 | Occurred | 0.32 | 62 |
| 20 | Occurred | 0.45 | 67 |
| 50 | Not occurred | 0.63 | 80 |
| 1000 | Not occurred | 0.82 | 85 |

*1: "C.A." represents a contact angle (degrees) after the image formation test.

As shown in Table 2, the backside contamination occurs when Tα is 0.45 or less. On the other hand, the backside contamination is obviated when Tα is 0.6 or more. The contact angle is an angle of contact with water of the secondary transfer roller 56, as a physical quantity. The contact angle was measured by a contact angle meter ("mobile Drop"), mfd. by Kruss (GmbH) and an amount of a droplet during measurement was 4 μl.

As understood from Table 2, when the contact angle is lowered, a degree of the backside contamination is worsen. The lowering in contact angle suggests an increase in surface free energy of the secondary transfer roller 56.

Embodiment 1

In view of the above-described problem, Embodiment 1 is carried out in order to improve the cleaning performance of the secondary transfer member cleaning device 7 for the secondary transfer roller 56 in the case where the control images are continuously formed.

In this embodiment, during post-rotation after completion of image formation in an image forming job, an electric discharge product deposited on the surface of the secondary transfer roller 56 is removed by transferring a restoring toner band onto the secondary transfer roller 56, so that the surface free energy is lowered. After the restoring toner band is transferred during the post-rotation, removal of the restoring toner band by cleaning with the secondary transfer member cleaning device 7 is performed in synchronism with intermediary transfer belt cleaning. As a result, different from the case of forming the restoring toner band during the pre-rotation, delay in start of image formation by waiting of the cleaning of the restoring toner band can be obviated. In this embodiment, the control images transferred onto the secondary transfer roller 56 are satisfactorily removed by the secondary transfer member cleaning device 7, so that the backside contamination of the recording material and image defects during printing on both sides are prevented.

Further, a good cleaning performance of the fur brush 71 for the secondary transfer roller 56 is always achieved while meeting control images formed at sheet intervals during image formation on various recording materials. As a result, the cleaning performance of the fur brush 71 for the secondary transfer roller 56 in the case of repetitively forming the control images at a predetermined interval in a sheet interval area between a plurality of recording materials is improved.

As understood from Table 2, it is necessary to restore the cleaning performance of the fur brush 71 when the job volume is less than 50 sheets, in order to perform image formation free from the backside contamination. For this reason, in this embodiment, during non-image formation, the restoring toner band is directly supplied to the secondary transfer roller 56 to lower the surface free energy of the secondary transfer roller 56.

The control portion 110 controls the image forming station Pa at an initial stage of the post-rotation for 10 seconds after completion of image formation in each of the jobs, so that the restoring toner band is formed and then is transferred onto the intermediary transfer belt 51. A restoring toner band forming condition at this time includes an amount of toner per unit area of the restoring toner band of 0.7 mg/cm$^2$ and a restoring toner band length of 226.1 mm corresponding to 3-full circumference of the secondary transfer roller 56.

In this embodiment, an experiment on an occurrence of the backside contamination was conducted in the same manner as in Experiment 1 except that the restoring toner band forming condition was changed to that described above when the job volume was 1 sheet, 5 sheets, 10 sheets, 20 sheets, 50 sheets and 1000 sheets.

In this experiment, an evaluation image had 10% duty of an image ratio to the size of paper and the control images were disposed at all sheet in intervals. As the recording material, a plain paper for PPC (80 g/m$^2$; available from Canon Kabushiki Kaisha) was used. The recording material had an A3 size. The number of sheets for evaluation of image formation was 5000 sheets in total for each of the job volumes.

Evaluation results including the backside contamination are shown in Table 3.

TABLE 3

| Job volume (sheets) | *1 B.C. | *2 N.O.J. | *3 R.T.A. | *4 C.A. | *5 Effect |
|---|---|---|---|---|---|
| 1 | A | 5000 | 54 | 73 | +20 |
| 5 | A | 1000 | 10.8 | 75 | +17 |
| 10 | A | 500 | 5.4 | 76 | +14 |
| 20 | A | 250 | 2.7 | 77 | +10 |
| 50 | A | 100 | 1.08 | 82 | +2 |
| 1000 | A | 5 | 0.054 | 86 | +1 |

*1: "B.C." represents the backside contamination during formation of the restoring toner band during the post-rotation. "A" represents that the backside contamination did not occur.
*2: "N.O.J." represents the number of (times of) jobs.
*3: "R.T.A." represents a restoring toner amount (g).
*4: "C.A." represents a contact angle (degrees) after the image formation test.
*5: "Effect" represents an effect of the restoring toner band in terms of an increase in contact angle obtained by subtracting a contact angle value in Experiment 1 from a contact angle value in this experiment.

An understood from Table 3, even when the job volume is 1 sheet, 5 sheets, 10 sheets and 20 sheets, by forming the restoring toner band during every post-rotation and transferring the restoring toner band onto the secondary transfer roller 56, the backside contamination is not caused to occur. Further, the contact angle is, compared with the case of Experiment 1 employing no restoring toner band, increased (restored) by 10 degrees or more.

Embodiment 2

Figure 5:
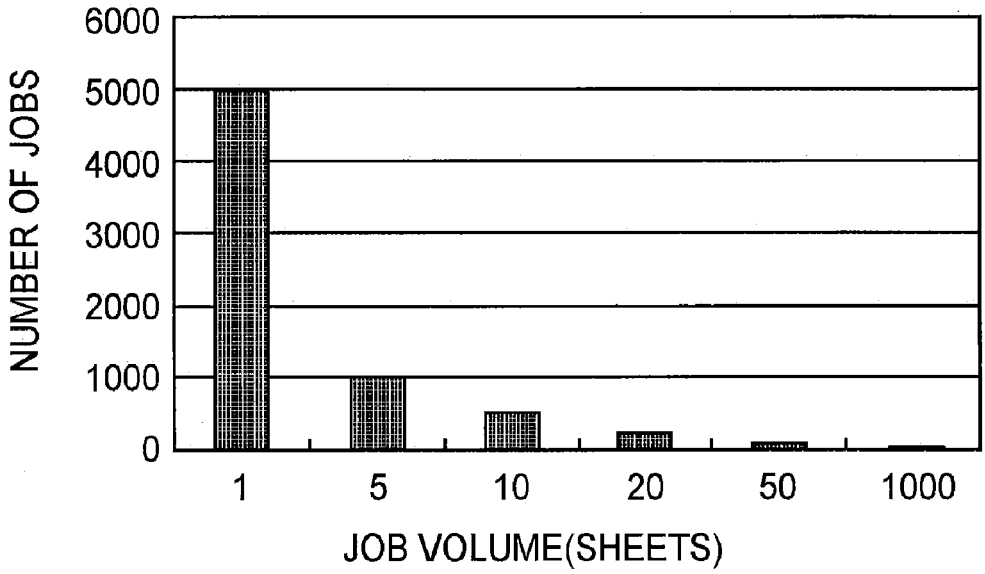
FIG. 5 is a graph showing a relationship between a job volume and the number of jobs when image formation on 5,000 sheets is performed.
Figure 6:
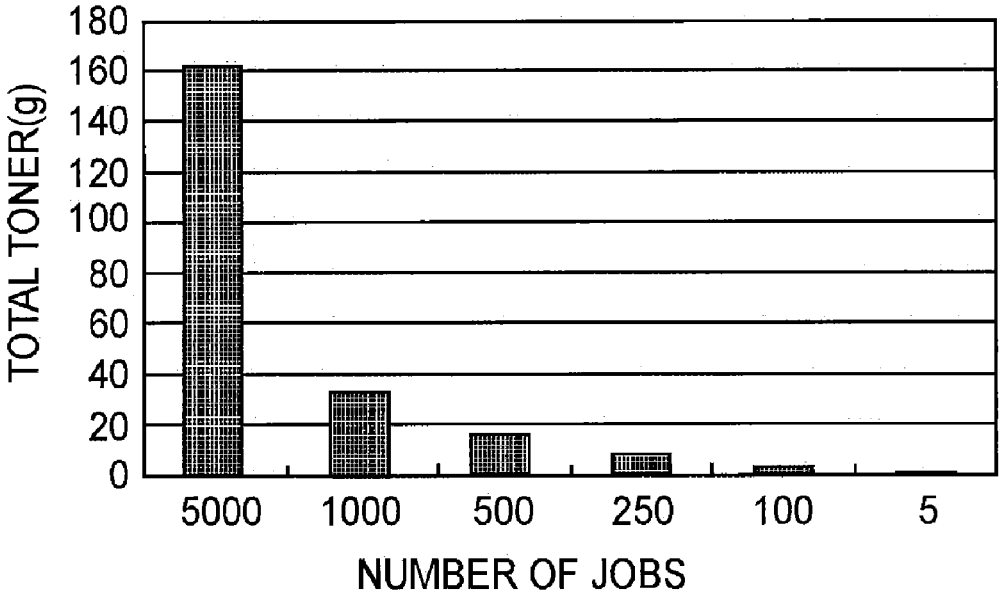
FIG. 6 is a graph showing a relationship between the number of jobs and a total amount of toner consumed for forming a restoring toner band.
Figure 7:
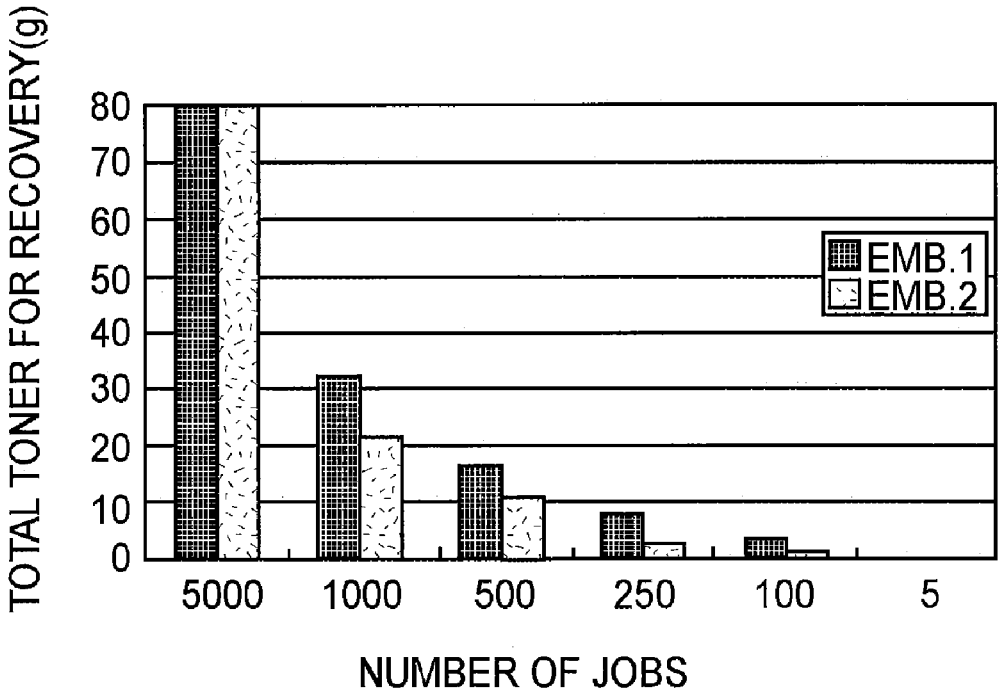
FIG. 7 is a graph showing a relationship between the number of jobs and a total amount of toner consumed for forming a restoring toner band in Embodiment 1 and Embodiment 2.
Figure 8:
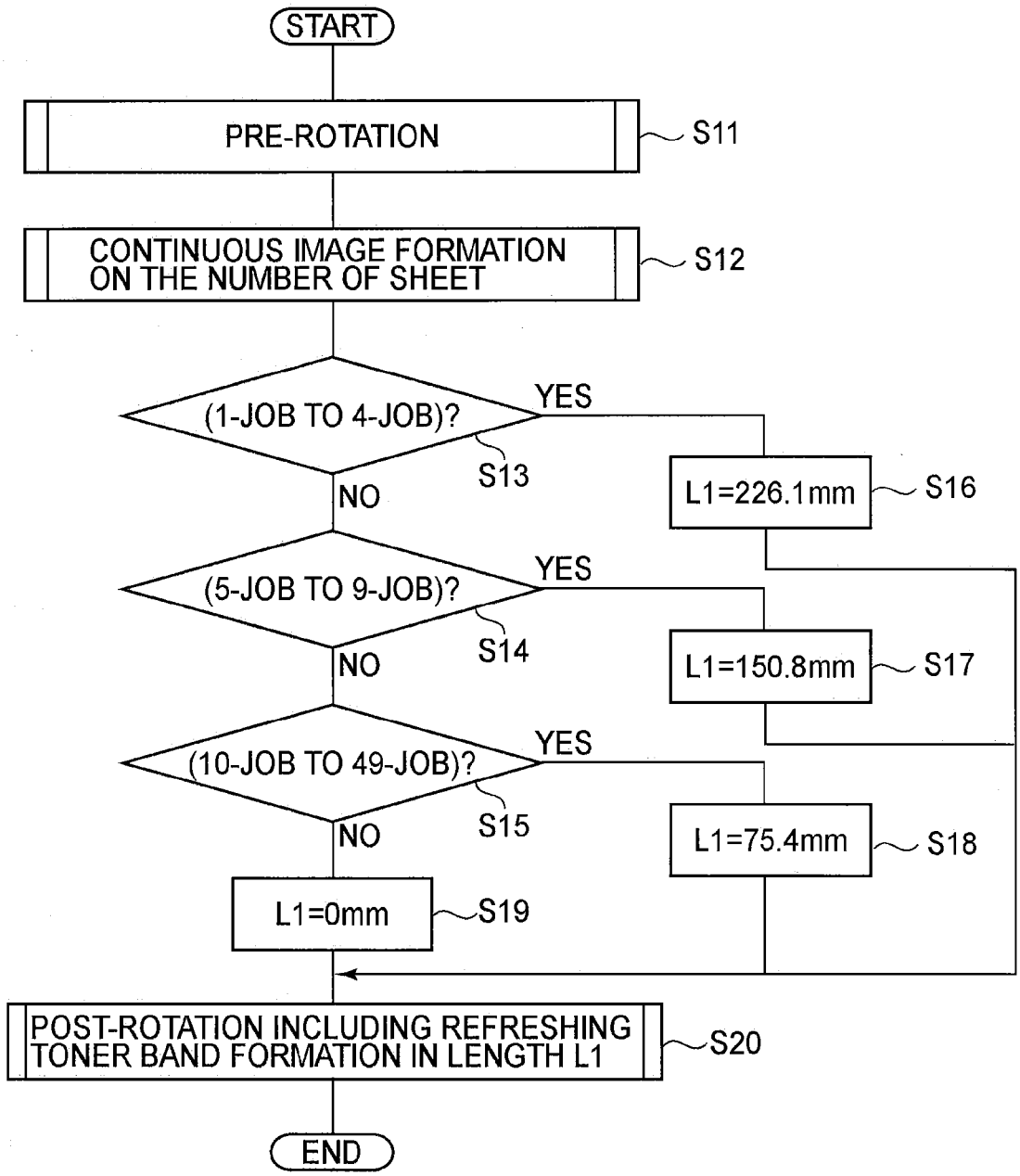
FIG. 8 is a flowchart of control in Embodiment 2.

FIG. 5 is a graph showing a relationship between a job volume and the number of jobs when image formation on 5,000 sheets is performed. FIG. 6 is a graph showing a relationship between the number of jobs and a total amount of toner consumed for forming a restoring toner band. FIG. 7 is a graph showing a relationship between the number of jobs and a total amount of toner consumed for forming a restoring toner band in Embodiment 1 and Embodiment 2. FIG. 8 is a flow chart of control in Embodiment 2.

As shown in FIG. 5, during printing on 5000 sheets in total, the number of jobs is increased inversely with the job volume. When the printing on 5000 sheets in total is performed, the number of jobs is decreased with an increasing job volume, so that the time ratio $T\alpha = T2/T1$ is increased.

As shown in FIG. 6, in the control in Embodiment 1, during the printing on 5000 sheets in total, the number of restoring toner band forming operations is increased with a smaller number of job volumes and a larger number of jobs, so that an amount of toner consumed for forming the restoring toner band is increased. Even during the printing on 5000 sheets in total, in the 5000-job, the toner amount required for forming the restoring toner band is about 20 times that in the 250-job.

However, as shown in Table 2, with an increase of the job volume in the order of 1 sheet, 5 sheets, 10 sheets and 20 sheets, the volume of the contact angle to be restored (increased) is increased. That is, a ratio of an amount of the electric discharge product to be removed by the contact with the recording material is increased, so that room capable of reducing the amount of toner used for forming the restoring toner band is increased.

Therefore, in Embodiment 2, the length of the restoring toner band is changed by the control portion 110 depending on the job volume set by the user. With an increasing job number in the order of 1 sheet, 5 sheets, 10 sheets and 20 sheets, the length of the restoring toner band is set to be shorter, thus saving an amount of toner consumption.

As also described in Embodiment 1, the occurrence of the backside contamination has a large sensitivity about the time ratio $T\alpha$. With a smaller time ratio $T\alpha$, the surface free energy of the secondary transfer roller 56 is increased, so that the contact angle with respect to water is decreased. For this reason, when the time ratio $T\alpha$ is large, the surface free energy of the secondary transfer roller 56 is lowered, so that recovery from the backside contamination is correspondingly quickened.

The restoring toner band may desirably be decreased in toner consumption amount as small as possible from the viewpoint of operating cost. It is also desirable that a minimum toner consumption amount is set for performing recovery from the backside contamination.

As shown in FIG. 8 with reference to FIG. 2, the control portion changes a length L1 of the restoring toner band depending on the job volume. The length L1 is set at 226.1 mm corresponding to 3-full circumference of the secondary transfer roller 56 in 1-job (YES of S13), at 150.8 mm corresponding to 2-full circumference of the secondary transfer roller 56 in 5-job (YES of S14), and at 75.4 mm corresponding to 1-full circumference of the secondary transfer roller 56 in 20-job (YES of S15).

In the case of the image forming jobs on 50 sheets or more (50-job or more) (NO of S15), lowering in cleaning performance of the secondary transfer member cleaning device 7 for the secondary transfer roller 56 is not caused to occur, so that the length L1 of the restoring toner band is zero, i.e., no restoring toner band is formed. Alternatively, the length L1 of the restoring toner band may also be set at a value smaller than that in the case of the image forming jobs on one sheet or more.

An experiment on an occurrence of the backside contamination was conducted in the same manner as in Embodiment 1 except that the length L1 of the restoring toner band was changed as described above when the job volume is 1 sheet, 5 sheets, 10 sheets, 20 sheets, 50 sheets and 1000 sheets.

Evaluation results of the occurrence of the backside contamination are shown in Table 4.

TABLE 4

| Job volume (sheets) | *1 B.C. |
|---|---|
| 1 | A |
| 5 | A |
| 10 | A |
| 20 | A |
| 50 | A |
| 1000 | A |

*1; "B.C." represents the backside contamination. "A" represents that the backside contamination did not occur.

As shown in Table 4, in this experiment, it was possible to maintain a good cleaning performance with respect to all the job volumes. As a result, it was confirmed that, even when the toner consumption amount was saved by decreasing the length of the restoring toner band, it was possible to prevent the occurrence of the backside contamination similarly as in Embodiment 1.

As shown in FIG. 7, when the number of jobs is 5000, the amount of toner consumed for forming the restoring toner band is not changed between Embodiment 2 and Embodiment 1. However, when the number of jobs is 1000 and 500, the toner consumption amount in Embodiment 2 is reduced to 66% of that in Embodiment 1. Further, when the number of jobs is 250 and 100, the toner consumption amount in Embodiment 2 is reduced to 33% of that in Embodiment 1.

As described above, in Embodiment 2, by changing the length of the restoring toner band depending on the number of jobs. The consumption amount of toner required for forming the restoring toner band is saved when compared with the case of Embodiment 1. By optimizing the amount of use of toner depending on the job volume, an unnecessary consumption of the toner is suppressed.

In Embodiment 2, as described above, during non-image formation, an electric discharge product deposited on the surface of the secondary transfer roller 56 is removed by directly supplying a restoring toner band to the secondary transfer roller 56, so that the surface free energy is lowered. As a result, high-density control images to be transferred onto the secondary transfer roller 56 during image formation are satisfactorily removed, so that the backside contamination of the recording material and image defects during printing on both sides are prevented.

Further, a good cleaning performance of the fur brush 71 for the secondary transfer roller 56 can be always achieved while meeting control images formed at sheet intervals during image formation on various recording materials. Therefore, the cleaning performance of the fur brush 71 for the secondary transfer roller 56 in the case of repetitively forming the control images at a predetermined interval in a sheet interval area between a plurality of recording materials can be improved.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 018724/2008 filed Jan. 30, 2008, which is hereby incorporated by reference.

What is claimed is:

1. An image forming apparatus comprising:

an image carrying member;

toner image forming means for forming a toner image on said image carrying member;

a transfer member, pressing a surface of said image carrying member, for forming a transfer portion for electrostatically transferring a toner image onto a recording material, wherein said toner image forming means is capable of forming an adjusting image for adjusting a toner image forming condition on said image carrying member, in a state in which said transfer member contacts said image carrying member, in a period between adjacent image forming operations during continuous image formation;

a cleaning member, contactable to said transfer member, for removing toner from said transfer member; and an executing portion capable of executing an operation in a mode, in which a toner band is supplied to said transfer member in a period from completion of image formation in a certain image forming job until start of image formation in a subsequent image forming job, depending on a number of image formations on the recording materials in the certain image forming job, wherein said executing portion executes the operation in the mode when the number of image formations on the recording materials in the certain image forming job is less than a predetermined number.

2. An apparatus according to claim 1, wherein the toner band has a length longer than a length of the adjusting image with respect to a movement direction of said image carrying member.

3. An apparatus according to claim 1, wherein said executing portion increases an amount of toner of the toner band to be supplied to said transfer member with a decreasing number of image formations in an image forming job.

4. An apparatus according to claim 1, wherein said executing portion supplies a toner image to said transfer member during a period from the completion of the image formation in an image forming job until rotation of said image carrying member is stopped.

5. An apparatus according to claim 1, wherein on said image carrying member, a yellow toner image, a magenta toner image, a cyan toner image and a black toner image are formed, and wherein said executing portion supplies the yellow toner image to said transfer member.

6. An apparatus according to claim 1, wherein said image forming apparatus further comprises a detecting portion for detecting the adjusting image and a changing portion for changing a toner image forming condition on the basis of an output of said detecting portion, wherein said toner image forming means forms the adjusting image in a state in which said transfer member and said image carrying member contact each other during a period between an image formation and a subsequent image formation.

7. An apparatus according to claim 1, wherein said cleaning member comprises a brush member, and wherein said image forming apparatus further comprises a collecting member for electrostatically collecting toner of the brush member and a removing member for removing the toner from said collecting member.

8. An apparatus according to claim 1, wherein when the number of image formations performed on the recording materials in the certain image forming job is more than the predetermined number, said executing portion does not execute formation of the toner band to be supplied to said transfer member.

9. An apparatus according to claim 1, wherein when the number of image formations performed on the recording materials in the certain image forming job is more than the predetermined number, said executing portion decreases an amount of the toner to be supplied to said transfer member compared with an amount of the toner when the number of image formations performed on the recording materials in the certain image forming job is less than the predetermined number.

* * * * *